US011358045B2

(12) United States Patent
Durbin

(10) Patent No.: US 11,358,045 B2
(45) Date of Patent: Jun. 14, 2022

(54) IMPLEMENT SUSPENSION AND MOVEMENT SYSTEM AND ASSOCIATED DEVICES AND METHODS

(71) Applicant: HybridUSA LLC, Ames, IA (US)

(72) Inventor: Benjamin Gregg Durbin, Ames, IA (US)

(73) Assignee: HybridUSA LLC, Ames, IA (US)

( * ) Notice: Subject to any disclaimer, the term of this patent is extended or adjusted under 35 U.S.C. 154(b) by 59 days.

(21) Appl. No.: 16/784,133

(22) Filed: Feb. 6, 2020

(65) Prior Publication Data

US 2020/0246673 A1 Aug. 6, 2020

Related U.S. Application Data

(60) Provisional application No. 62/801,836, filed on Feb. 6, 2019.

(51) Int. Cl.
*A63B 69/20* (2006.01)
*A63B 71/00* (2006.01)

(52) U.S. Cl.
CPC ..... *A63B 71/0036* (2013.01); *A63B 69/201* (2013.01)

(58) Field of Classification Search
CPC ..... A63B 71/0036; A63B 69/201; A63B 2209/10; A63B 2071/009; A63B 2225/09; A63B 69/34; A63B 69/24; A63B 69/20–345
See application file for complete search history.

(56) References Cited

U.S. PATENT DOCUMENTS 2,153,384 A * 4/1939 Mazza ..... A63B 69/345 473/443
3,424,458 A * 1/1969 Henry, Jr. ..... A63B 69/345 473/443
3,659,848 A * 5/1972 DePew ..... A63B 69/345 473/443
3,780,663 A * 12/1973 Pettit ..... A61G 7/1051 104/307
4,529,194 A * 7/1985 Haaheim ..... A63B 21/012 482/70
4,545,575 A * 10/1985 Forjot ..... A63B 69/18 104/91
4,948,118 A * 8/1990 Miraglia ..... A61H 3/008 104/62
5,048,822 A * 9/1991 Murphy ..... A63B 69/201 482/7
5,224,912 A * 7/1993 Moody ..... A63B 69/201 482/86
5,524,548 A * 6/1996 Fox ..... B61H 7/00 104/249
5,685,227 A * 11/1997 Gaccetta ..... B61B 3/00 104/250
6,389,618 B1 * 5/2002 Flynn ..... A61G 7/1042 5/81.1 R (Continued)

*Primary Examiner* — Nyca T Nguyen
(74) *Attorney, Agent, or Firm* — Dentons Davis Brown, P.C.; Matthew Warner-Blankenship

(57) ABSTRACT

A system for securing exercise equipment including an elongate suspended rail and at least one braking device. The at least one braking device including a brake plate, a wheel assembly, a spring, and an actuator. The system wherein the braking device is arranged with the rail such that the braking device can be secured at any point along the rail.

20 Claims, 13 Drawing Sheets

(56) References Cited

U.S. PATENT DOCUMENTS

| | | | | |
|---|---|---|---|---|
| 6,530,867 | B2 * | 3/2003 | Schwendemann | A63B 69/004 482/83 |
| 6,758,794 | B2 * | 7/2004 | Lee | A63B 69/24 482/83 |
| 7,484,461 | B2 * | 2/2009 | Britcher | A63B 69/201 104/89 |
| 7,635,322 | B2 * | 12/2009 | Parrilla | A63B 21/078 482/104 |
| 8,777,819 | B1 * | 7/2014 | Quintana | A63B 69/201 482/87 |
| 8,790,198 | B1 * | 7/2014 | Russell | A63B 69/34 473/443 |
| 8,882,641 | B2 * | 11/2014 | Cutler | A63B 22/0605 482/83 |
| 8,978,821 | B2 * | 3/2015 | Galpin | A62B 35/0081 182/36 |
| 9,056,235 | B1 * | 6/2015 | Mortland | A63B 71/023 |
| 9,089,465 | B2 * | 7/2015 | Galloway | A61G 7/1078 |
| 9,353,601 | B2 * | 5/2016 | Hause | E21B 41/00 |
| 10,661,141 | B1 * | 5/2020 | Boisture | A63B 24/0062 |
| 2007/0101894 | A1 * | 5/2007 | Britcher | B61B 3/00 104/89 |
| 2008/0026918 | A1 * | 1/2008 | Lemke | A63B 69/345 482/87 |
| 2017/0216679 | A1 * | 8/2017 | McCoy | A63B 69/205 |
| 2019/0110941 | A1 * | 4/2019 | Jader | A61G 12/004 |
| 2019/0299043 | A1 * | 10/2019 | Gisin | A63B 21/0626 |
| 2019/0366141 | A1 * | 12/2019 | Cylvick | A63B 71/0054 |
| 2020/0352814 | A1 * | 11/2020 | Lajoie | A61H 3/008 |

* cited by examiner

IMPLEMENT SUSPENSION AND MOVEMENT SYSTEM AND ASSOCIATED DEVICES AND METHODS

CROSS-REFERENCE TO RELATED APPLICATION(S)

This application claims the benefit under 35 U.S.C. § 119(e) to U.S. Provisional Application 62/801,836, filed Feb. 6, 2019, and entitled "Implement Suspension and Movement System and Associated Devices and Methods," which is hereby incorporated by reference in its entirety for all purposes.

TECHNICAL FIELD

The various embodiments disclosed herein relate to a movement and mounting mechanism, especially mechanisms for movement and mounting along a rail.

BACKGROUND

The present disclosure relates to slidable movement and securing of various equipment suspended along a rail. Heavy and bulky exercise equipment, for example punching bags, can take up a lot of space on a gym floor and can be difficult to move onto a floor when needed for use and off of the floor when not in use.

There is a need in the art for devices, systems and methods for quickly and easily moving heavy equipment suspended along a rail and securing the equipment in place along the rail.

BRIEF SUMMARY

Discussed herein are various devices, systems, and methods for slidably moving and securing equipment along a rail.

One general Example includes a system for securing exercise equipment including an elongate suspended rail, and at least one braking device. The braking device may also include a brake plate, a wheel assembly, a spring, and an actuator. Some examples include system where the braking device is arranged with the rail such that the braking device can be secured at any point along the rail.

Implementations may include one or more of the following features. The system further including a brake pad. The system further including a spring plate. The system where the actuator is a cable having a handle. The system where the wheel assembly is disposed opposite the brake plate so as to bracket the rail. The system where the spring is in operational communication with the actuator, brake plate and brake pad so as to urge the brake pad toward the rail, and on actuation of the actuator release the braking device from the rail for slidable communication.

Another Example includes an exercise device, including an elongate rail, a plurality of braking devices, an actuator in operational communication with the plurality of breaking devices, a plurality of implements suspended from the plurality of braking devices. Some include the device where the plurality of braking devices are constructed and arranged so as to be in slidable communication with the rail and transition between secured and sliding states via actuation of the actuator.

Implementations may include one or more of the following features. The device where each of the plurality of braking devices is in operational communication with a wheel assembly. The device where the breaking device include at least one spring and a brake plate. The device further including a brake pad. The device where the spring is in operational communication with the actuator, brake plate and brake pad so as to urge the brake pad toward the rail, and on actuation of the actuator release the braking device from the rail for slidable communication. The device further including a spring plate. The device where the actuator is a cable having a handle. The device where the plurality of implements are heavy bags. The device where the braking device further includes one or more wheels.

Another Example includes a braking device for the suspension of heavy bags, including a brake plate, a brake pad secured to the brake plate, a wheel assembly, and a spring in operational communication with the brake plate. Some examples include the braking device where the braking device is constructed and arranged so as to be in slidable communication with a rail and transition between secured and sliding states via actuation of the actuator.

Implementations may include one or more of the following features. The device further including a rail defining a lumen. The device where the spring is in operational communication with the actuator and biased so as to urge the brake pad toward the rail, and upon actuation of the actuator release the braking device from the rail for slidable communication of the braking device with the rail. The device where the wheel assembly is configured to be disposed within the lumen so as to facilitate the slidable communication. The device further including one or more wheels constructed and arranged to be in rolling communication with a rail and configured to operate as a fulcrum for the actuator.

While multiple embodiments are disclosed, still other embodiments of the disclosure will become apparent to those skilled in the art from the following detailed description, which shows and describes illustrative embodiments of the invention. As will be realized, the disclosure is capable of modifications in various obvious aspects, all without departing from the spirit and scope of the disclosure. Accordingly, the drawings and detailed description are to be regarded as illustrative in nature and not restrictive.

DETAILED DESCRIPTION

The various embodiments disclosed herein relate to devices, systems, and methods for suspension and movement of suspended implements—such as exercise equipment—along a rail. The several embodiments disclosed herein allow for safe, and easy movement of various equipment, especially heavy equipment, along a rail. Certain embodiments allow for stopping the suspended implement or implements at any point along the rail and securing it in place for use. The various embodiments, additionally, allow for the absorbing of forces, that may be applied to the suspended equipment, from 360°.

Figure 1A:
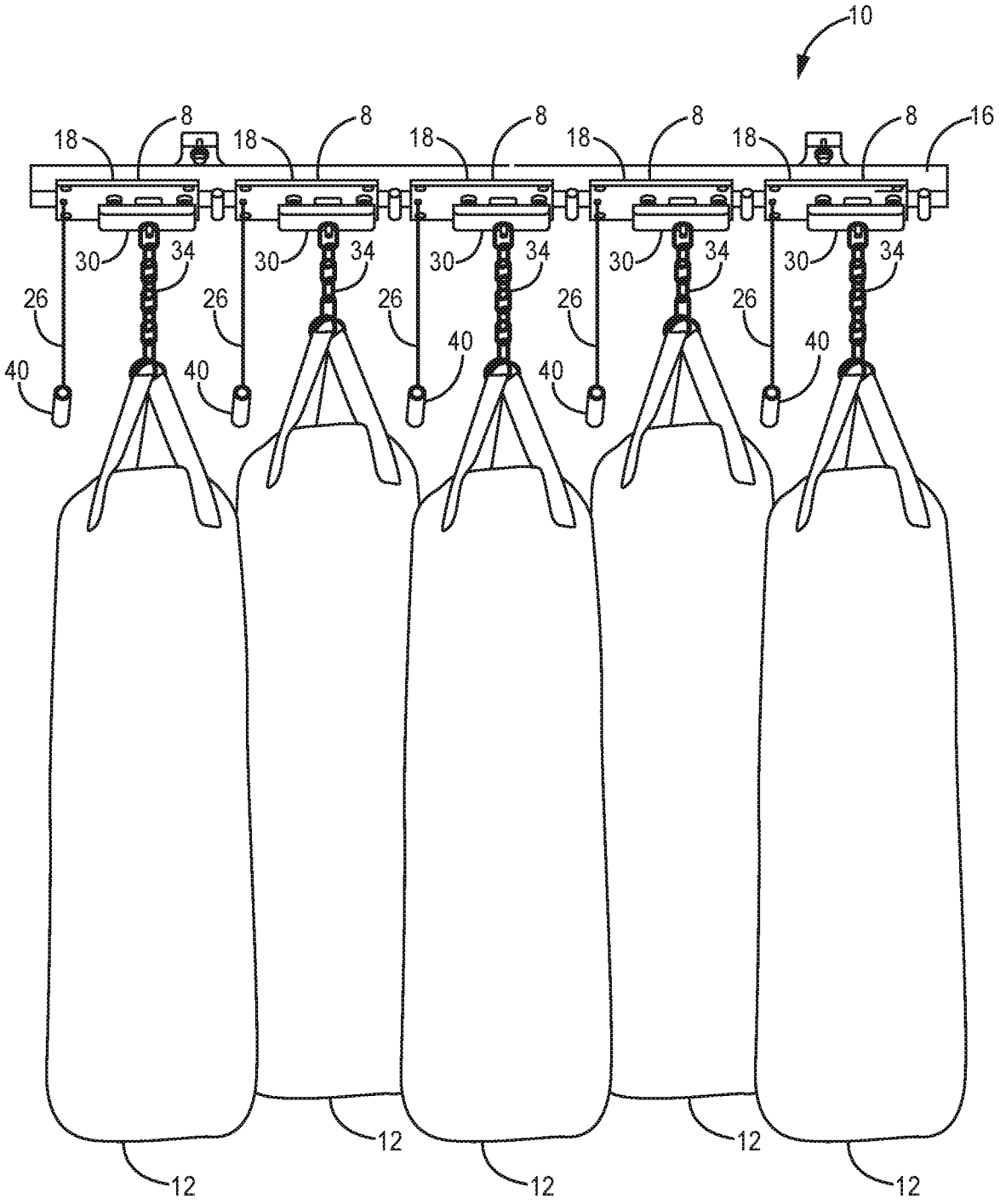
FIG. 1A is a side view of the system, according to one implementation.
Figure 1B:
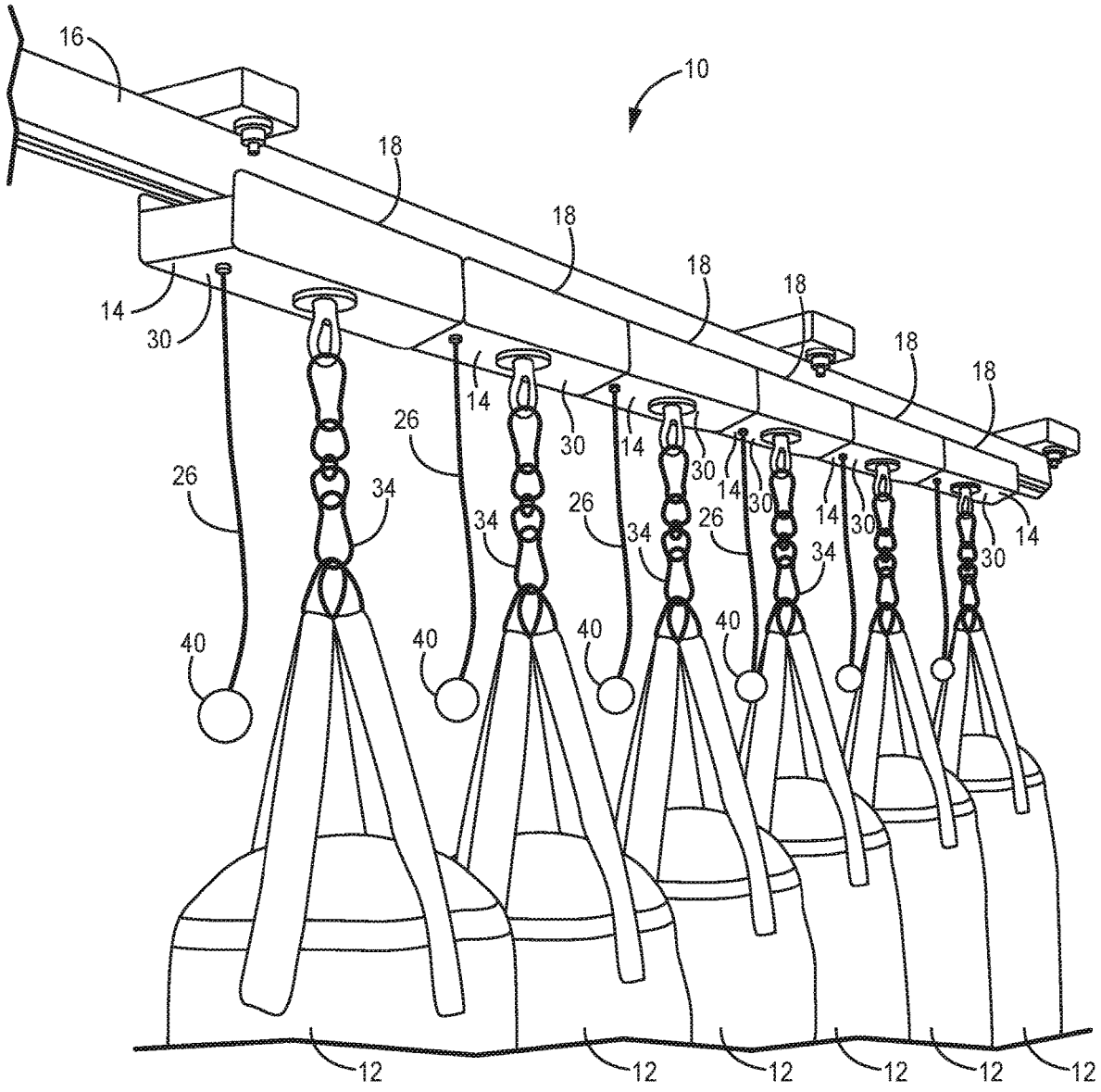
FIG. 1B is a side view of the system, according to another implementation.

Turning to the figures in more detail, FIGS. 1A and 1B depict various implementations of the system 10 in use with equipment 12, namely heavy bags 12, such as those that would be used in boxing, martial arts and other training programs, as would be understood. According to the implementations of FIGS. 1A and 1B, the system 10 suspends the equipment 12 on an anchored elongate rail 16 that is in turn suspended or otherwise operationally attached to a ceiling, adjacent walls, or other structure as would be appreciated by those of skill in the art. It is appreciated that the implementations of FIGS. 1A and 1B can be used to slide and secure various additional pieces of equipment 12, such as heavy bags 12 or other equipment 12, as would be appreciated. It is further appreciated that in alternate implementations the rail 16 can be secured via brackets, braces, or other appropriate structures as would be appreciated. Additional implementations are of course possible.

Figure 5:
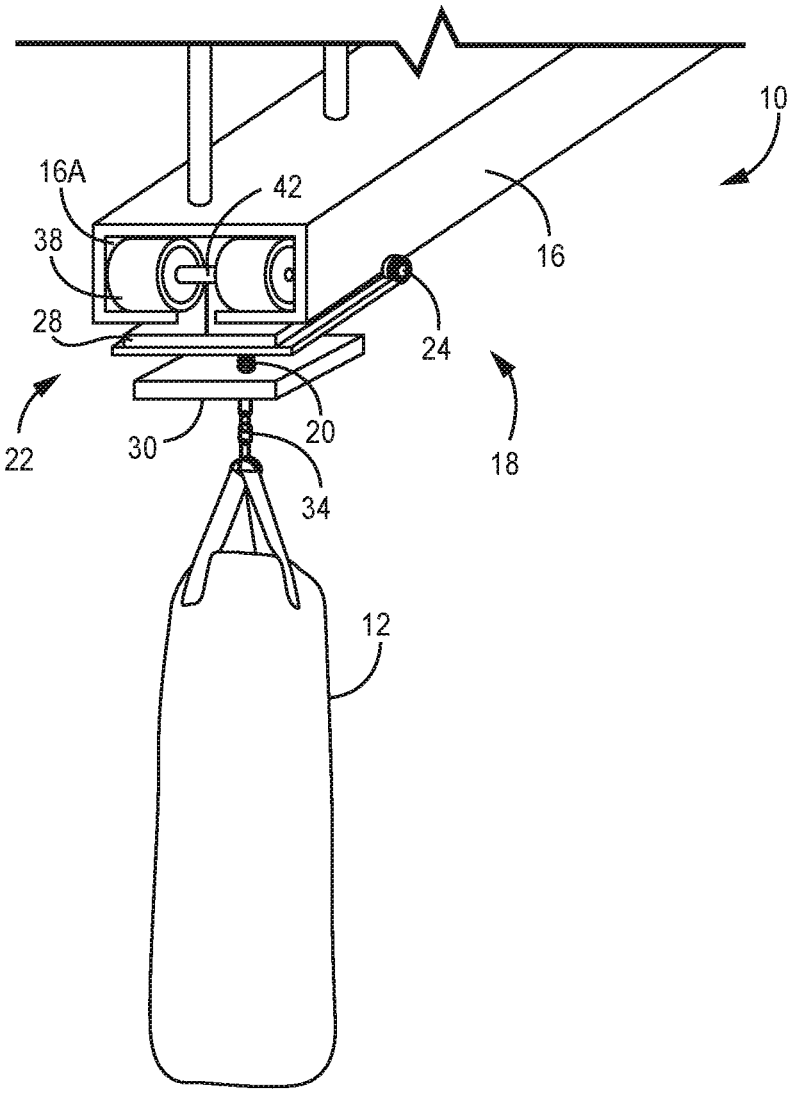
FIG. 5 is a cross sectional view of the system, according to one implementation.
Figure 6:
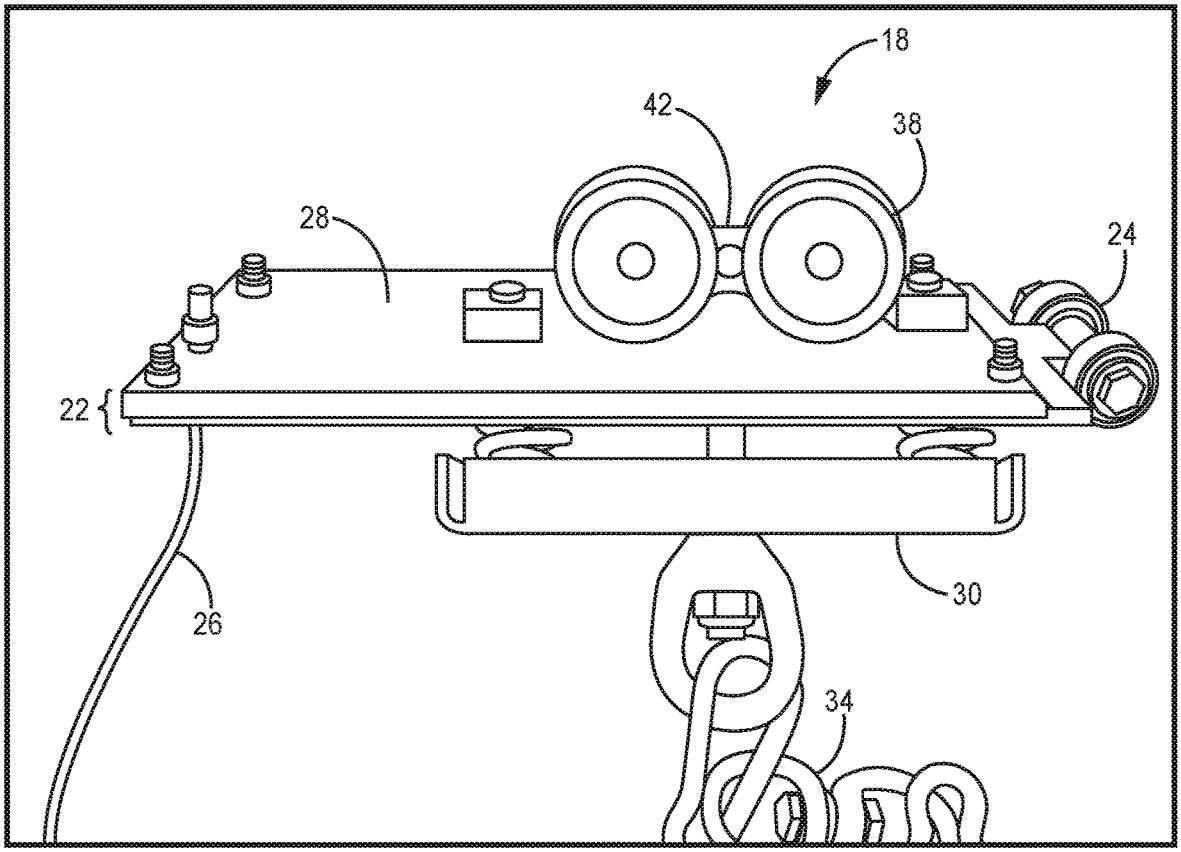
FIG. 6 is a side view of the braking device detached from the rail, according to one implementation.
Figure 7:
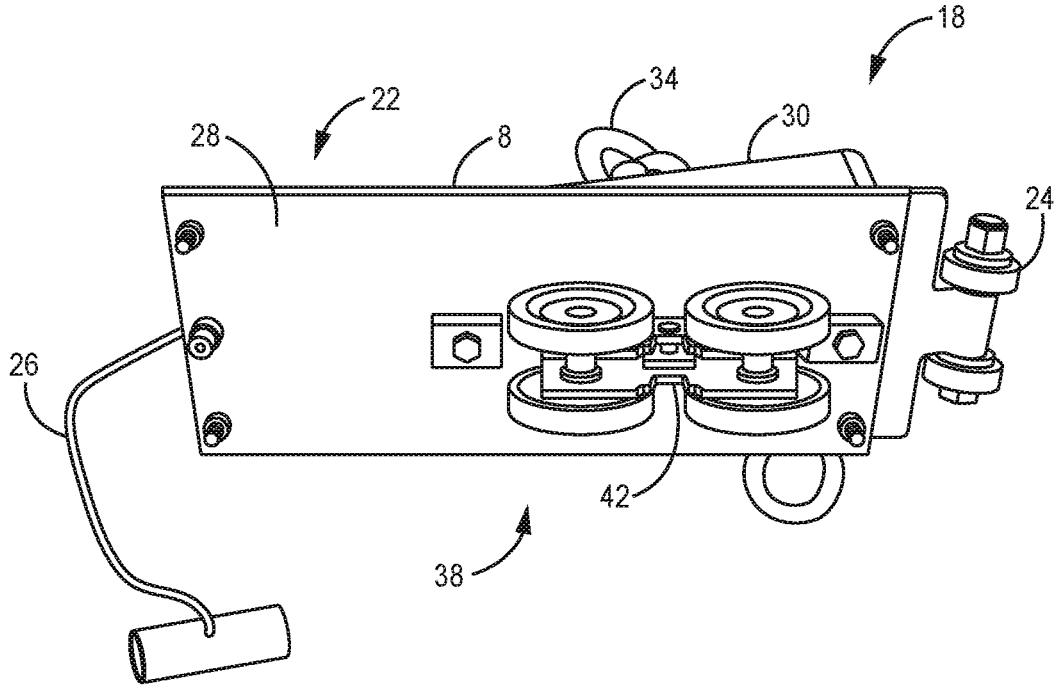
FIG. 7 is a top perspective view of the braking device detached from the rail, according to one implementation.

In implementations of the system 10 like that of FIGS. 1A-1B, a selective braking device 18 is in slidable communication with the rail 16 via a wheel assembly (shown in FIG. 5-7 at 38). The braking device 18 has a body 8 and is constructed and arranged so as to allow for the transition between sliding and secured states, thereby permitting the suspension, sliding and securement of various kinds or pieces of equipment 12 along the rail 16 during use. In certain implementations, and as would be appreciated by those of skill in the art, the equipment 12 may be attached to the braking device 18 via a connector 34, such as but not limited to a bolt 34 and/or a chain 34.

In various implementations, shown in FIG. 1B, the braking device 18 optionally includes a cover 14. The cover 14 may enclose the braking device 18 and include a hook or loop for attachment of a connector 34, such that the equipment 12 is suspended from the cover 14. In various implementations, the cover 14 is integral with the spring plate 30, as discussed herein.

It is thus appreciated that in various implementations, the system 10 allows for the equipment 12 to be urged so as to slide along the rail 16 and then fixed in a desired location via the braking device 18. That is, the braking device 18 allows for sliding and then securing the equipment 12 at any point along the rail 16. In various implementations, the equipment 12 may be pulled along the rail 16 via an actuator 26 such as a cable 26. In certain of these implementations, the actuator 26 can be in operational communication with the braking device 18 to toggle between engaged and disengaged or free movement and locked states. That is, when the actuator 26 is pulled away from the braking device 18 the braking device 18 is disengaged allowing for movement of the braking device 18 with attached equipment 12 along the rail 16. In some embodiments, the cable 26 may have a handle 40 at one end, to assist in pulling of the cable 26, as would be readily appreciated.

Figure 2:
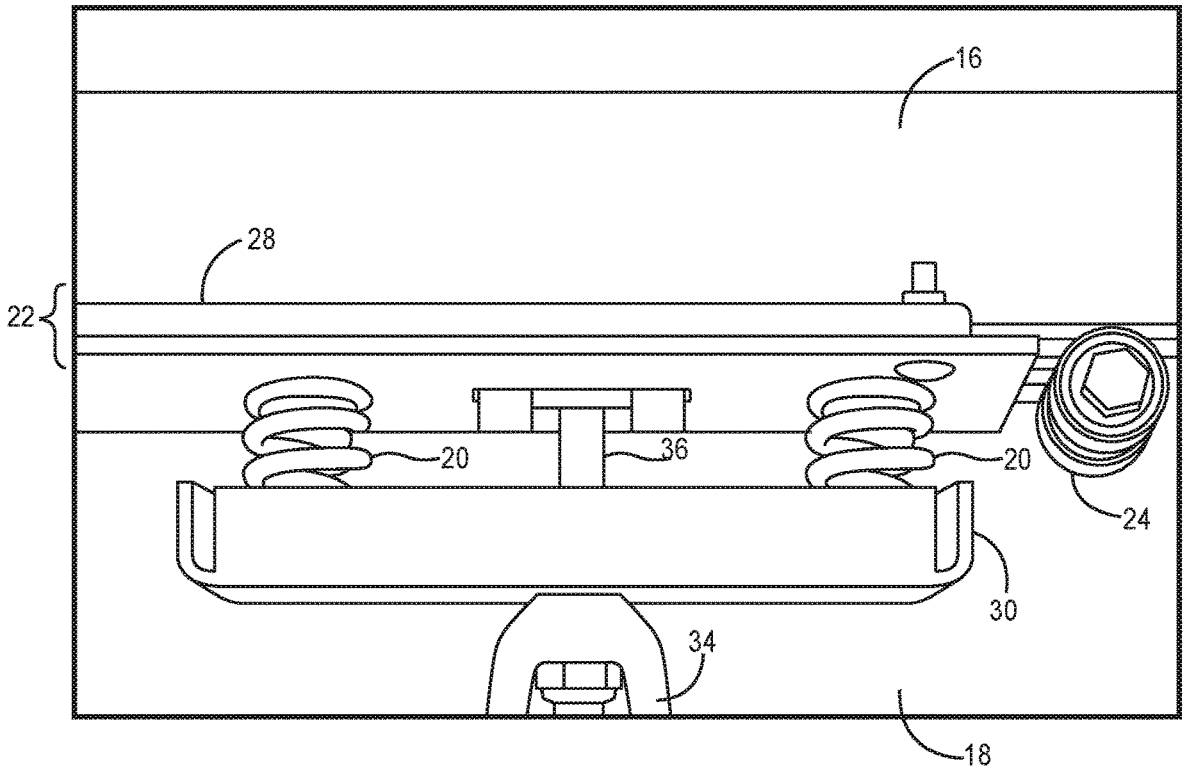
FIG. 2 is a side view of the braking device, according to one implementation.
Figure 3A:
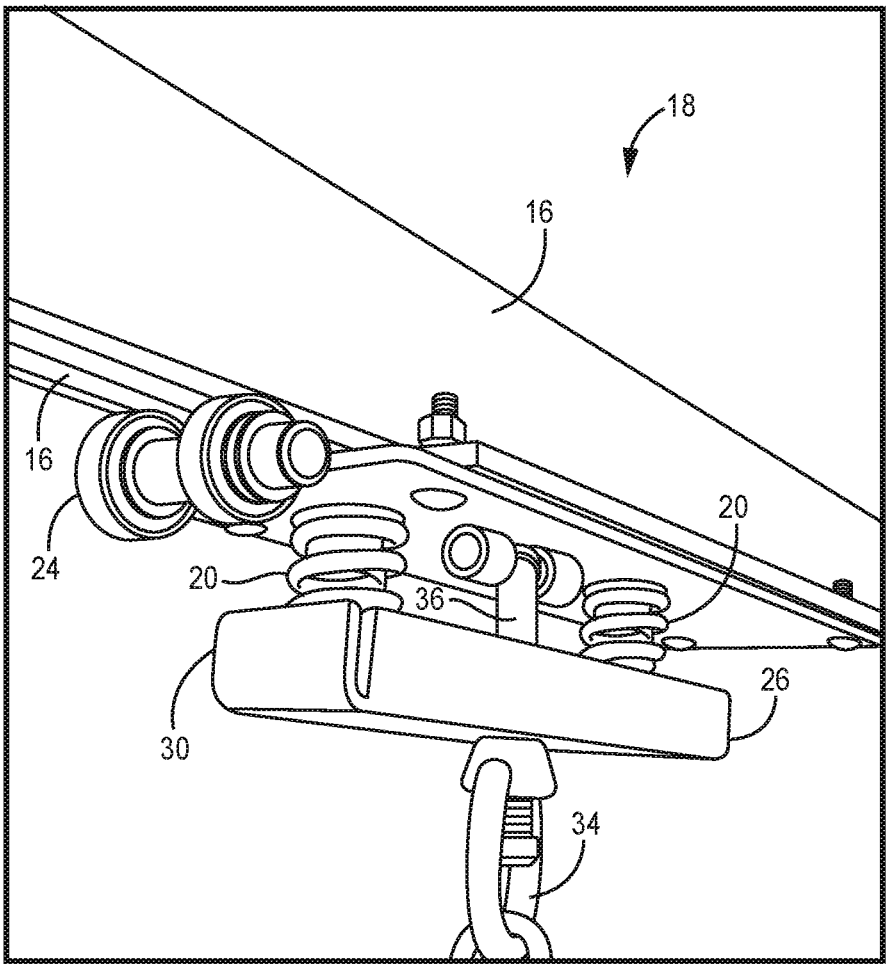
FIG. 3A is a perspective view of the braking device, according to one implementation.
Figure 3B:
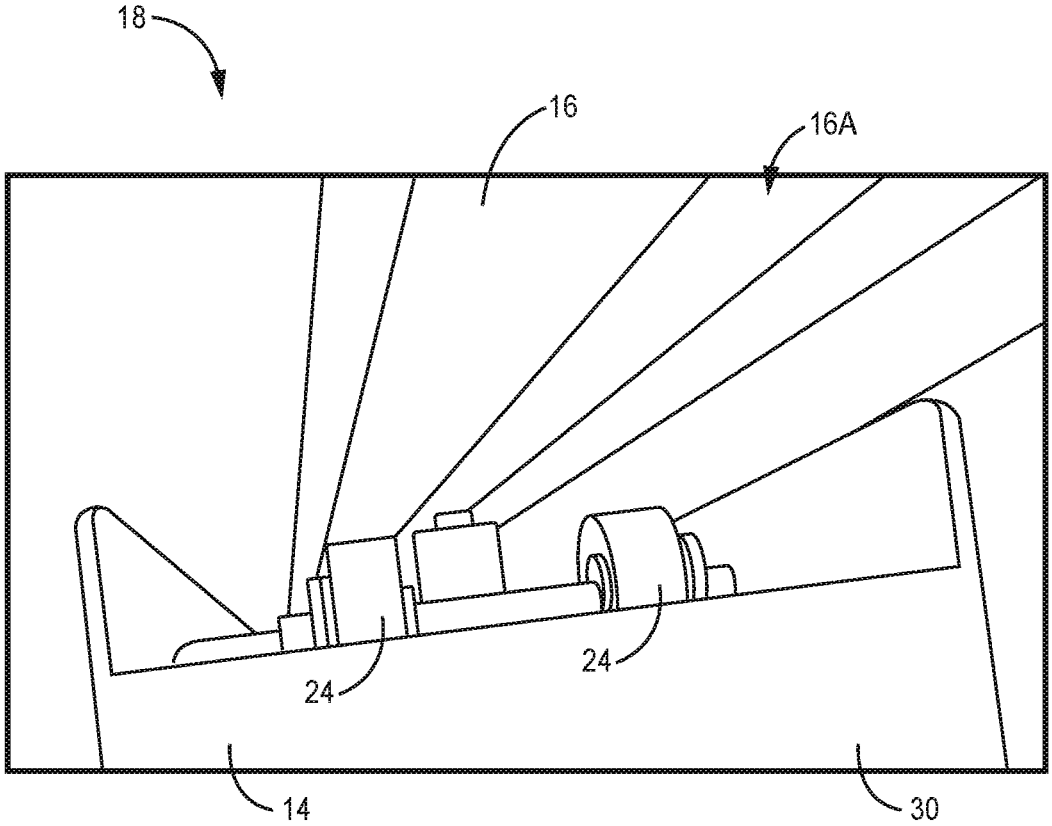
FIG. 3B depicts a rear view of the braking device, according to one implementation.
Figure 3C:
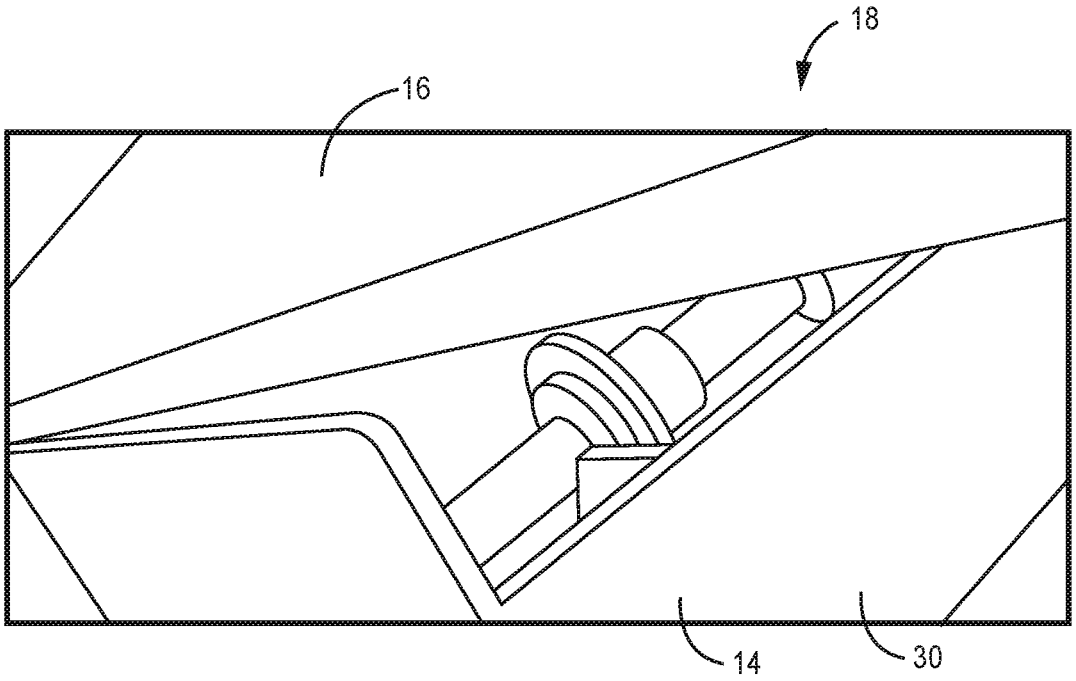
FIG. 3C depicts a top perspective view of the braking device, according to one implementation.
Figure 3D:
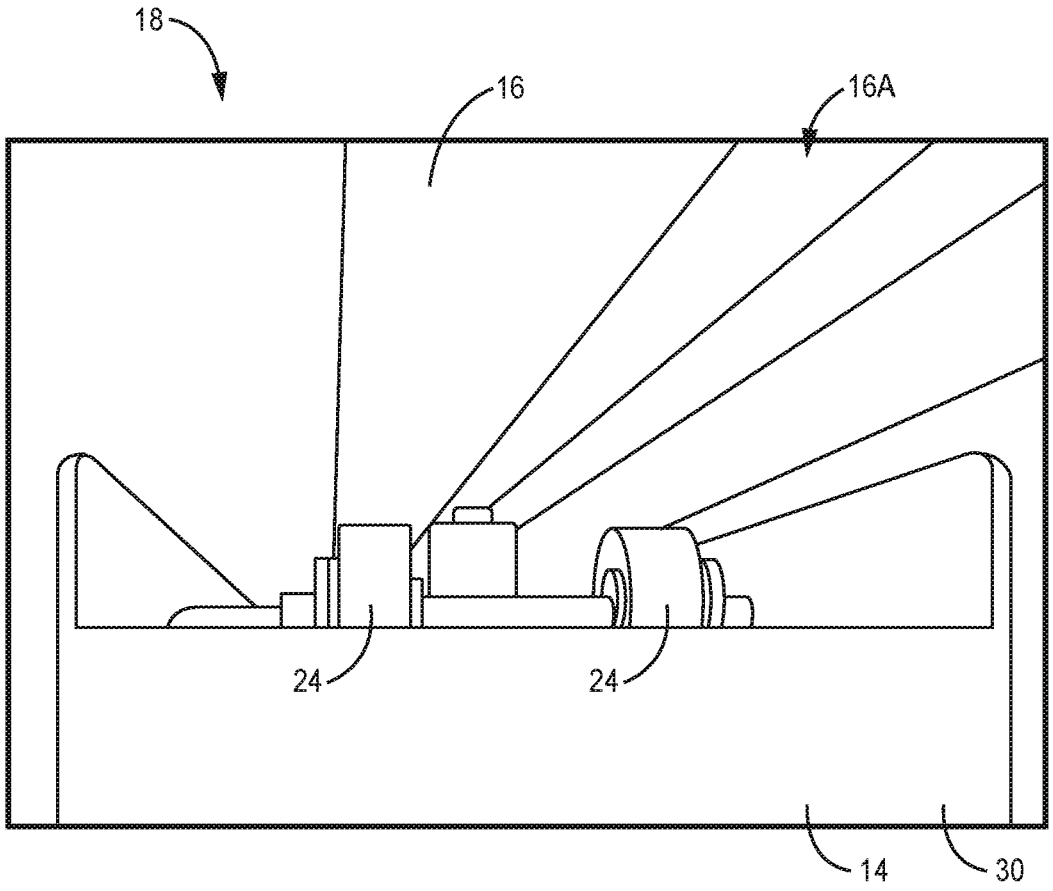
FIG. 3D depicts a rear view of the braking device, according to one implementation.
Figure 4:
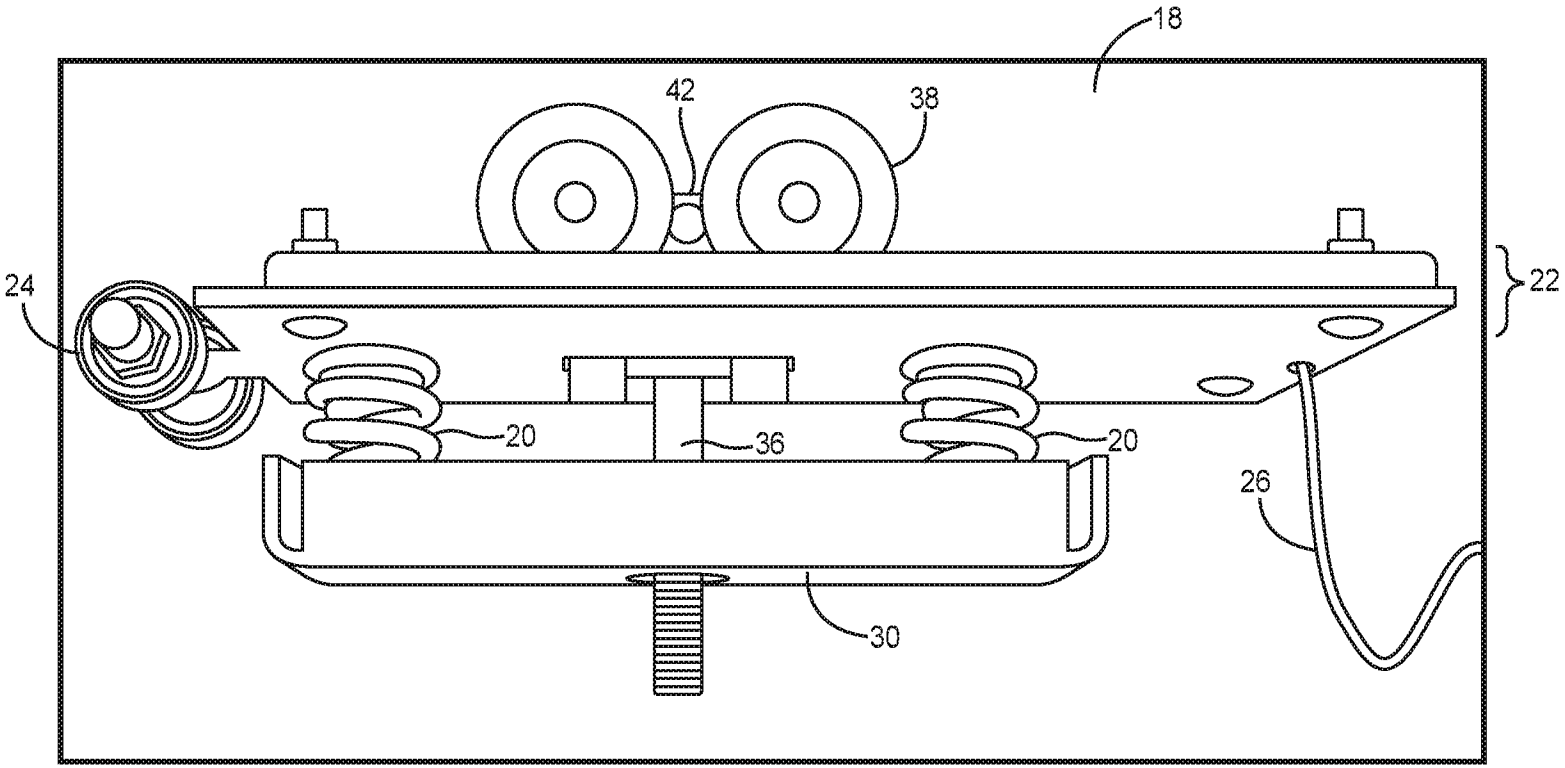
FIG. 4 is a side view of the braking device detached from the rail, according to one implementation.

As shown in FIGS. 2-4, in some embodiments, the braking device 18 has several components allowing for the sliding and securing of the braking device 18 along the rail 16. FIG. 2 depicts a side view of the braking device 18 attached to the rail 16, FIG. 3A depicts a perspective view of the braking device 18 attached to the rail, FIG. 3B depicts a rear view of the braking device 18 attached to a rail 16; FIG. 3C depicts a top perspective view of the braking device 18 and rail 16; FIG. 3D depicts a rear view of the braking device 18; FIG. 4 depicts a side view of the braking device 18. In certain implementations the braking device 18 comprises at least springs 20, a brake plate 22, one or more wheels 24, an actuator 26 or other attachment, a brake pad 28 and a spring plate 30. It is appreciated that various of these components are optional, and that certain implementations can feature less than all or none.

In various implementations, the brake plate 22 includes a brake pad 28. The brake pad 28 according to these implementations may be made of rubber or any other material, known to those of skill in the art, that is able to create adequate friction between the braking device 18 and the rail 16. In some embodiments, the brake pad 28 is removably secured to the brake plate 22 such as by bolts or other known attachment mechanisms. It is understood that these attachments allow for the brake pad 28 to be replaced as needed or desired.

In some embodiments, the brake plate 22 may be substantially rectangular and about 10 inches long and the width of the rail 16, while other sizes and shapes are contemplated and would be appreciated by those of skill in the art. It is appreciated that various sizes can increase the contact area and weight of the brake pad 28 and brake plate 22.

The brake plate 22 according to these implementations is operationally coupled to a set of wheels 24. The wheels 24 allow for "slidable" movement of the braking device 18 along the rail 16 via rolling contact, as would be appreciated. The set of wheels 24 according to these implementations additionally provides a pivot point for the braking device 18 relative to the rail 16, such that the braking device 18 can disengage from the rail 16. In further implementations, the wheels 24 act as a fulcrum allowing for pivotally movement of the brake plate 22 relative to the rail 16. It is readily appreciated that in certain implementations, the wheels 24 can be disposed centrally relative to the brake plate 22, or at either end to provide additional leverage. It is further appreciated that the wheels 24 are constructed and arranged to be in rolling communication with the rail 16.

In some implementations, attached to the brake plate 22 are at least two springs 20. The at least two springs 20 are attached to the spring plate 30 at their opposite end. The springs 20 are in operational communication with the brake plate so as to be capable of applying force to the brake plate 22 when actuated, thereby causing the brake pad 28 to come into contact with the rail 16. That is the springs 20 are biased to default toward a braked, or engaged position along the rail 16. This contact prevents the braking device 18 from moving along the rail 16 when the braking device 18 is engaged. The braking device 18 is held in place as described above at any point along the rail 16.

In some implementations, a spring plate 30 is suspended below the brake plate 22 and attached to the springs 20. The brake plate 22 and spring plate 30 are operatively engaged via a bolt assembly 36 (shown in more detail in FIGS. 3A-4). In various embodiments, the springs 20 absorb shock from any angle reducing transferred torque on the rail 16, creating a more stable system 10. The bolt assembly 36 may be adjustable such that the spring plate 30 may provide more or less force/compression on the brake plate 22 via the springs 20. As the bolt assembly 36 is loosened the amount of force applied to the brake plate 22 via the springs 20 is lessened and vice versa.

In various embodiments like those depicted in FIGS. 3A-4, the brake plate 22 has a cable 26 attached to one end, opposite the set of wheels 24. The actuator 26 when pulled disengages the brake plate 22, such that the brake plate 22 pivots around the wheels 24 allowing for movement of the device 18, as described above. As the amount of force on the brake plate 22 is lessened, as described above, the less force is required on the cable 26 to disengage the brake plate 22.

FIGS. 5-7 depict the braking device in more detail. FIG. 5 depicts a perspective cross-sectional view of the system 10, according to certain implementations; FIG. 6 depicts a side view of the braking device 18 and wheel assembly 38; FIG. 7 depicts a top perspective view of the braking device 18 and wheel assembly 38.

In these and other implementations, the rail 16 has a lumen 16A defined therein. The lumen 16A of these implementations encloses the wheel assembly 38. The wheel assembly 38 according to these implementations is disposed inside the lumen 16A and constructed and arranged so as to be capable of lateral movement along the rail 16 in either direction during use. The wheel assembly 38 may comprise two sets of wheels disposed on axles 42, while other configurations are possible. It is further appreciated that the wheels of the wheel assembly can be disposed in parallel within the lumen 16A, as shown in FIG. 5, or in a linear, horizontal arrangement, such as outside the rail and coupling the rail on either side. As would be readily appreciated by those of skill in the art, the wheel assembly 38 can take a number of understood forms of being in rolling communication with the rail 16.

The axles 42 of the wheel assembly 38 may be operatively connected to the bolt assembly 36, described above. In certain implementations, the wheel assembly 38 is coupled or otherwise in operational communication with the braking device 18 mounted below the rail 16 via a bolt assembly 36, or other mechanism known to those of skill in the art. Other implementations are of course possible.

Figure 8:
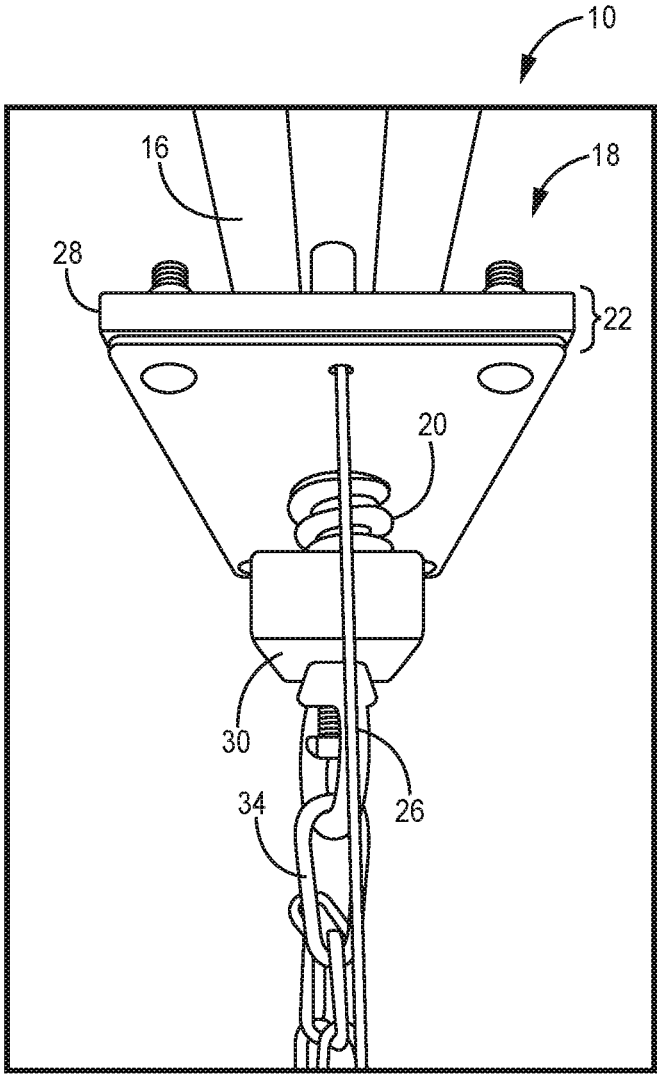
FIG. 8 is a front view of the braking device, according to one implementation.

FIG. 8 depicts a front view of the braking device 18, according to one implementation. The cable 26 is attached to the front of the brake plate 22. The cable 26 is attached to the brake plate 22 in any manner known to those of skill in the art. The cable 26 can be pulled down and away from the brake plate 22, causing the brake plate 22 to pivot around the wheels 24 (shown and described above), and disengage from the rail 16. When disengaged from the rail 16 the braking device 18 can be moved along the rail 16. Once the braking device 18 is disengaged the cable 26 may assist in moving the braking device 18 and equipment 12 (shown and described above) along the rail 16 by pulling the cable 26 in the desired direction.

Figure 9:
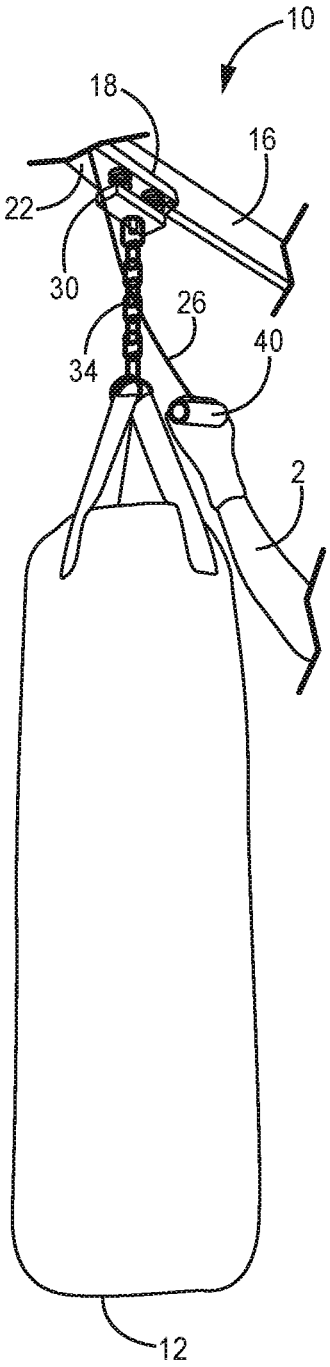
FIG. 9 is a perspective view of the system in use, according to one implementation.

FIG. 9 depicts the system 10 in use. A user 2 pulls down on the cable 26, disengaging the braking device 18. By disengaging the braking device 18, the braking device 18 can be moved along the rail 16 by pulling the cable 26 in the desired direction. By moving the braking device 18 any implement 12 attached to the braking device 18 via a connector 34 is also moved along the rail 16 to any desired point.

Although the disclosure has been described with references to various embodiments, persons skilled in the art will recognized that changes may be made in form and detail without departing from the spirit and scope of this disclosure.

What is claimed is:

1. A system for securing exercise equipment comprising:
a) an elongate suspended rail defining a lumen; and
b) at least one braking device slidably secured along the elongate suspended rail comprising:
i) a brake plate;
ii) a set of wheels disposed at one end of the brake plate and engaged with a first side of the elongate suspended rail;
iii) a wheel assembly disposed within the lumen;
iv) a spring plate engaged with the brake plate via a bolt assembly;
v) at least two springs each engaged at one end to the spring plate and at a second end to the brake plate; and
vi) an actuator disposed at a second end of the brake plate,
wherein the braking device is arranged with the rail such that the braking device is configured to be secured at any point along the rail when in a secured configuration and wherein the set of wheels is a pivot point for the breaking device relative to the elongate suspended rail such that the braking device is laterally movable along the rail when in a disengaged position.

2. The system of claim 1, further comprising a brake pad attached to the brake plate and configured to be engaged with the first side of the elongate suspended rail.

3. The system of claim 1, further comprising a cover integrated with the spring plate.

4. The system of claim 1, wherein the actuator is a cable having a handle.

5. The system of claim 1, further comprising a connector for suspension of an implement from the spring plate.

6. The system of claim 5, wherein the implement is a heavy bag.

7. The system of claim 1, wherein the at least two springs are biased toward the secured configuration.

8. The system of claim 1, wherein the at least two springs are configured to absorb shock applied to the breaking device or implement attached thereto.

9. The system of claim 1, wherein the bolt assembly is adjustable to increase or decrease force applied by the at least two springs to the brake plate.

10. The system of claim 1, wherein the wheel assembly comprises two pairs of wheels disposed on axels.

11. An exercise device, comprising:
a) an elongate rail;
b) a plurality of braking devices, each braking device comprising:
i) a wheel assembly disposed within a lumen of the elongate rail;
ii) a brake plate operatively engaged with the wheel assembly via a bolt assembly;
iii) a set of wheels disposed at a first end of the brake plate, the set of wheels capable of slidable movement along the elongate rail and allowing pivotable movement of the brake plate relative to the elongate rail; and
iv) a spring plate suspended from the brake plate via the bolt assembly;
c) at least one actuator in operational communication with each of the plurality of breaking devices at a second end of the brake plate; and d) at least one implement suspended from each of the plurality of braking devices, wherein the plurality of braking devices are constructed and arranged so as to:

i) be in slidable communication with the rail, and ii) transition between secured and sliding states via actuation of the actuator.

12. The device of claim 11, wherein the brake plate further comprises a brake pad.

13. The device of claim 11, wherein the at least one spring is in operational communication with the actuator and brake plate so as to urge the brake plate towards the elongate rail, and on actuation of the actuator release the braking device from the rail for slidable movement.

14. The device of claim 11, wherein the breaking device further comprises at least one spring engaged with the spring plate and brake plate and configured to provide a force to contact the brake plate with the elongate rail.

15. The device of claim 11, wherein the actuator is a cable having a handle.

16. The device of claim 11, wherein the plurality of implements comprise heavy bags.

17. A braking device for the suspension of heavy bags, comprising:

a) a brake plate;

b) a brake pad secured to the brake plate;

c) a wheel assembly configured to be disposed within a lumen of a rail and operatively engaged with the brake plate via a bolt assembly;

d) a set of wheels affixed to the brake plate and engaged with an outer portion of the rail; and e) at least one spring in operational communication with the brake plate configured to provide a biasing force to the brake plate to engage the brake pad with the outer portion of the rail, wherein the braking device is constructed and arranged so as to:

i) be in slidable communication with a rail, and ii) transition between secured and sliding states via actuation of an actuator.

18. The device of claim 17, wherein the at least one spring is in operational communication with the actuator, and upon actuation of the actuator the braking device releases the brake plate and brake pad from the rail for slidable movement of the braking device along the rail.

19. The device of claim 17, wherein the wheel assembly is configured to be disposed within the lumen so as to facilitate slidable movement.

20. The device of claim 17, wherein the set of wheels is configured to operate as a fulcrum for the actuator.

* * * * *